United States Patent [19]

Meyer

[11] Patent Number: 4,462,604

[45] Date of Patent: Jul. 31, 1984

[54] SIZE-ADJUSTABLE ERECTING WHEELCHAIR

[75] Inventor: Bruno Meyer, Wohlen, Switzerland

[73] Assignee: Valutec AG, Dottikon, Switzerland

[21] Appl. No.: 377,603

[22] Filed: May 13, 1982

[30] Foreign Application Priority Data

May 18, 1981 [CH] Switzerland ..... 3222/81

[51] Int. Cl.[3] ..... A61G 5/02

[52] U.S. Cl. ..... 280/242 WC; 280/650; 297/DIG. 10

[58] Field of Search ..... 297/118, 130, 283, 383, 297/DIG. 10; 180/DIG. 3; 280/242 WC, 289 WC, 647, 648, 650

[56] References Cited

U.S. PATENT DOCUMENTS

| | | | |
|---|---|---|---|
| 3,937,490 | 2/1976 | Nasr | 280/242 WC |
| 4,076,304 | 2/1978 | Deucher | 297/45 |
| 4,141,094 | 2/1979 | Ferguson et al. | 297/DIG. 10 X |
| 4,166,631 | 9/1979 | Sanaski | 280/242 WC |
| 4,351,540 | 9/1982 | Minnebraker | 280/242 WC |
| 4,358,125 | 11/1982 | Charles | 280/242 WC |
| 4,360,213 | 11/1982 | Rudwick et al. | 280/242 WC |

FOREIGN PATENT DOCUMENTS

| | | | |
|---|---|---|---|
| 0018101 | 3/1980 | European Pat. Off. . | |
| 2625046 | 12/1977 | Fed. Rep. of Germany | 297/DIG. 10 |

OTHER PUBLICATIONS

PCT-WO81/03610 6/81 Bergman.

*Primary Examiner*—Joseph F. Peters, Jr.
*Assistant Examiner*—Michael Mar
*Attorney, Agent, or Firm*—Frishauf, Holtz, Goodman & Woodward

[57] ABSTRACT

A main frame (11), supporting main wheels (25) at different wheel positions, is coupled to a seat erection frame (13) by a parallogram linkage. To permit matching of the erecting chair to different-size persons, for example so that it can "grow" with growth of a child for whom it is initially purchased, the parallelogram linkage (45) connecting the back (35) to the frame (13) can be provided in interchangeable sets of different-length links (45*a*, 45*b*) to respectively move the back (35) in different positions with respect to the front edge (34*a*) of the seat, the ground support (37) likewise being adjustable to accommodate differently tall patients, adjustment of the seat with respect to ground level being additionally obtained by adjusting the height of front caster wheels (27) with respect to the main frame. The position of the main wheels (25) can be relocated with respect to the center of the seat (33) by different pivot locations on the main frame.

6 Claims, 6 Drawing Figures

SIZE-ADJUSTABLE ERECTING WHEELCHAIR

Figure 2:
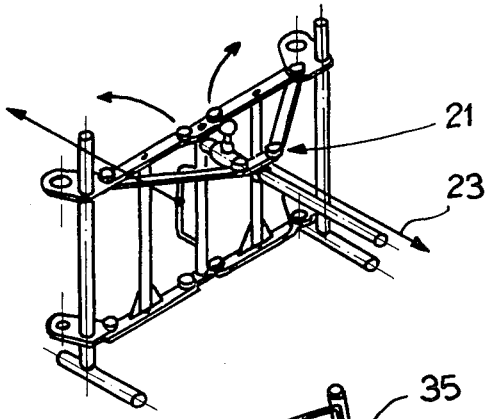
Fig. 2 PRIOR ART

Reference to related U.S. Patent, assigned to the assignee of this application, the disclosure of which is hereby incorporated by reference: U.S. Pat. No. 4,076,304, issued in Feb. 28, 1978, DEUCHER.

The present invention relates to an erecting seat structure of the type described in the referenced U.S. Pat. No. 4,076,304, DEUCHER, assigned to the assignee of this application. Such a seat structure is capable of erecting, that is, to assist invalids from seated to standing, upright position. The structure is particularly adaptable for use with wheelchairs, and the present invention is especially directed to wheelchairs of this type which "grow with the patient".

BACKGROUND

Erecting-type wheelchairs, particularly of the motorized type, are expensive. Wheelchairs can be matched only to a limited extent to the size of the patient. Erecting-type wheelchairs for children were practically unavailable. A limited degree of adjustability is provided by placing length-adjustable elements on footrests. The length of the seat, and the positioning of the backrest with respect to the seat, cannot be adjusted. To make such wheelchairs suitable for persons of different sizes, and particularly for growing children, it was customary to use cushions or other makeshift arrangements in order to provide the required space between the back of the erecting wheelchair and the seating surface if the chair was to be used by smaller persons.

It has previously been proposed—see Published European Application No. 0 018 101—to construct the side frame of a collapsible wheelchair in such a manner that telescopic elements are used which permit changing the distance between the wheels of the wheelchair. Attachment elements are provided at various positions of the side frame to permit, selectively, installation of a larger or a smaller main wheel. The structure described in this application permits varying the width of a seat; since, however, the arrangement refers to an ordinary type of wheelchair—not an erecting-type wheelchair—no solution to match an erecting-type wheelchair to different sizes of patients is given. Erecting-type wheelchairs require a separate seating and erecting frame.

A collapsible wheelchair is further shown in U.S. Pat. No. 4,082,348, which permits adjusting the height of the seating surface by carrying the seat by telescopically fitting tubes. The positioning, that is, the telescopic fit of the tubes, is determined by suitable holding elements. The length of the seat cannot, however, be matched to a particular person, so that a standard size of this type wheelchair is not suitable for use with children or for persons of unusual height.

THE INVENTION

It is an object to so construct an erecting-type wheelchair that it can be matched to different sizes of patients and, further, to so provide a wheelchair that it can "grow" with a person so that the expensive basic structure need be purchased only once, for example for a child, which can be matched to the size of the child as the child grows. Further, the wheelchair should be so arranged that a basic structure can be provided with differently sized elements interchangeably provided to match the resulting erecting-type wheelchair to a person of any size, even if above average size.

Briefly, the wheelchair to which the present invention relates has a basic frame structure which also supports two main wheels, and at least one, preferably two caster wheels. The base frame also retains a seat erecting frame which includes a seat, a backrest and a footrest. A pivoting axis is provided connecting the seat-erecting frame and portions thereof to the main or support frame; a parallelogram linkage pivoting in part about the pivot axis maintains the seat back at a vertical position, during erecting movement and upon erection of the seat and the backrest to assist a person to rise with and on the chair, and being supported by the chair.

In accordance with the invention, the erecting feature of a chair having a base frame is maintained by selectively repositioning elements of the chair, for example by interchange of differently sized elements, with respect to the pivot axis about which the back rest pivots upon erection of the frame, being maintained vertically by the parallelogram linkage. The main wheels can be placed at different positions with respect to the pivot axis, by locating them along attachment struts, or similar elements which have a plurality of bearing positions, so that the main wheels can be moved closer to, or farther away, from the front edge of the seat which is placed at a predetermined distance from the pivot axis. This, then, also permits replacing the seat with a seat element which is longer, or shorter, respectively. The parallelogram linkage, likewise, is replaceable, maintaining the pivot axis, but changing the length so that the position of the backrest with respect to the front edge of the seat, and hence with respect to the pivot axis can be changed. Thus, seats of shorter or longer length, backrests of lower or higher position and properly spaced from the back of the seat can be accomodated, and the main wheels, likewise, can be moved within easy reach of users of different sizes seated, respectively, on the shorter or longer seats. Height adjustment is provided by lengthening or shortening footrest struts and base supports with respect to the seat while maintaining a predetermined distance to ground level, in order to maintain stability upon erection of the chair. This then permits use of caster wheels of different sizes or otherwise changing the height of the rolling surface of the caster wheels in tubular supports, or the like.

In spite of the various adjustment possibilities, with respect to size and height of the chair, it can readily be collapsed by spacing side frame members by collapsible struts; thus, the chair can not only "grow" with a patient or, by replacing only a few elements, can be matched to the size of a patient; it can, additionally, be collapsed like any other non-adjustable chair.

The chair has the advantage that its rather expensive structure can be provided for an invalid child which, as the child grows, need not be replaced but can "grow with the child". The requirement for repeatedly buying larger chairs is thus avoided. It is only necessary to replace the seat and portions of the parallel linkage. Replacing the parallel linkage elements solves the problem of keeping the backrest upright in any position of the chair regardless of the size of the person. If the invalid grows to become tall, above average, further replacement of the seat is possible and additionally providing a lengthened parallel linkage arrangement. If a large seat is used, the main wheels of the erecting chair, which can be first used as a chair for children, are undesirably located and, in order to permit the chair to be universally applicable, a plurality of bearing points for the main wheels are provided on the chair so that mere repositioning of the wheels again results in an ergonometric desirable position of the wheels with respect to a user in the chair.

The footrests must contact the ground when the chair is in erected position, but they are released upwardly from the ground when the chair is moved. In erected position, the feet of the person should be close to the ground. In moving position, they should be sufficiently distant to clear the ground surface. To permit the chair to be used by children, as well as by persons above average height, the front edge of the seat can be adjusted in height depending on the length of the footrest. Front adjustment, in accordance with a feature of the invention, is obtained by replacing the caster wheel or the caster wheel attachment, such as a leg or pin or holding bolt, or stub. Alternatively, the front casters can be retained within a telescoping tube, and height-adjustably mounted therein. This is a simple and easy way to change the height of the seat edge with respect to ground level. Re-adjustment of the positioning of the caster wheel is simple; it is usually not required frequently, and a semi-permanent attachment is suitable.

The wheelchair, thus, has the advantage that it can be self-erecting, together with rising of a person from seated position; not only can it be made or adapted for differently sized patients, but it can also be folded. The footrest itself may form the ground rest. It is so positioned that, in erected position, the footrest is on ground level. This prevents tipping of the chair in erected position.

The entire chair can be made of lightweight construction without creating danger that it may tip; tubular elements of high-strength aluminum may be used for the frame.

DRAWINGS

Figure 1:
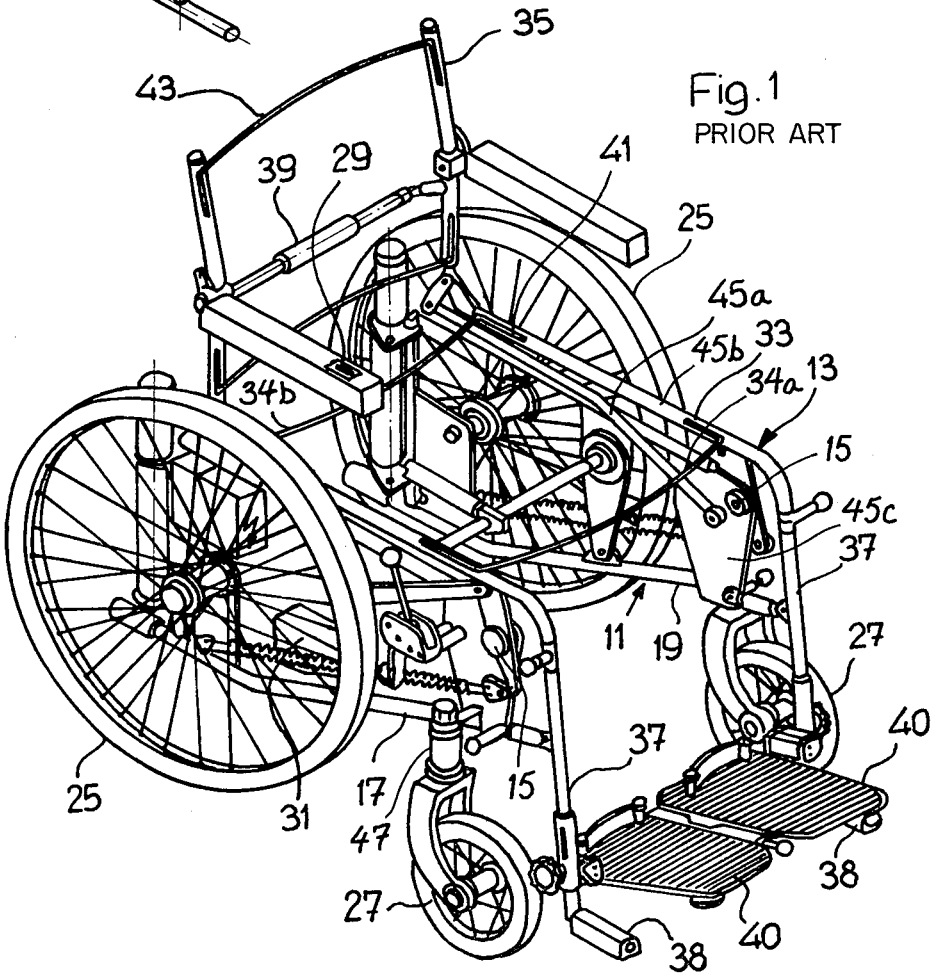
Fig. 1 PRIOR ART
Figure 3:
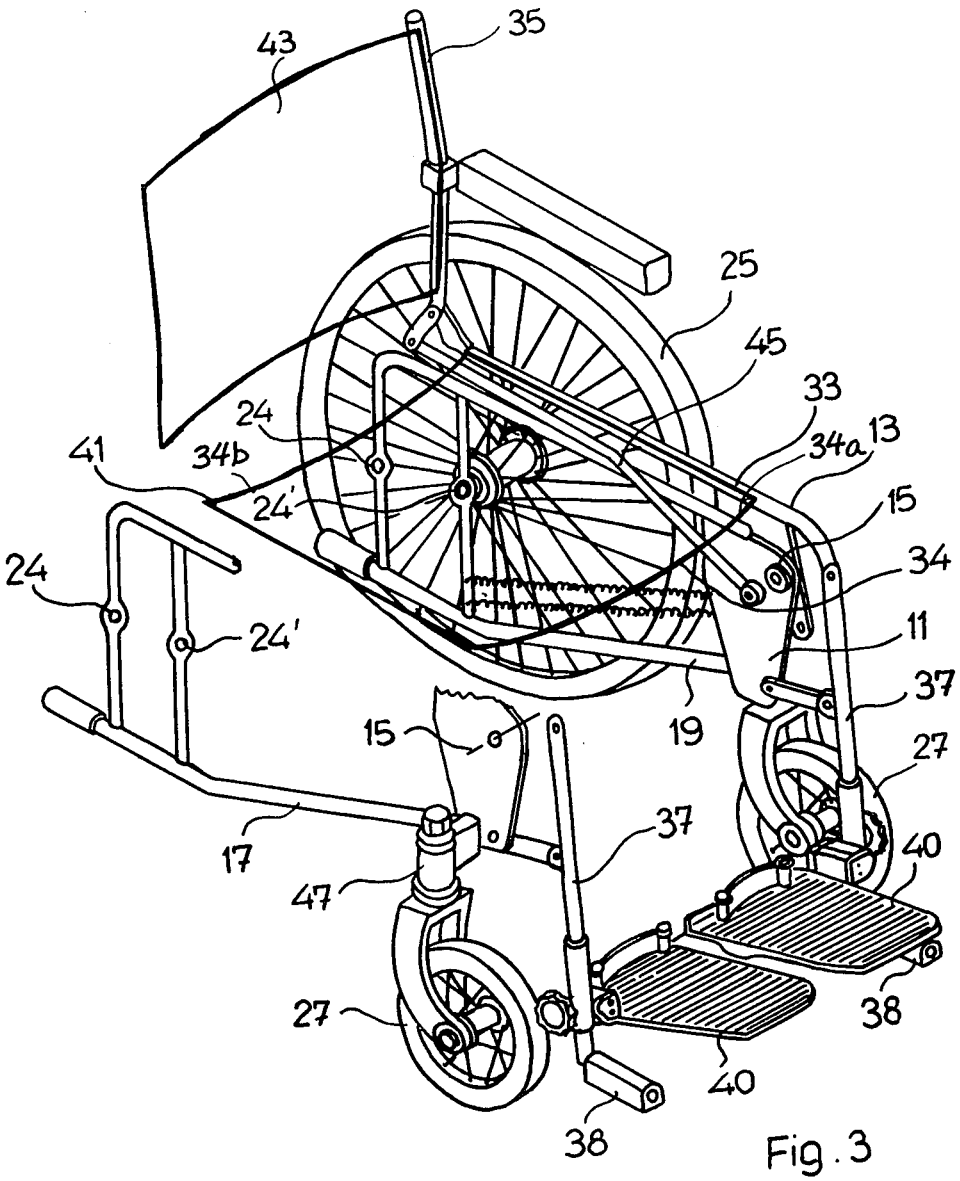
Figure 4:
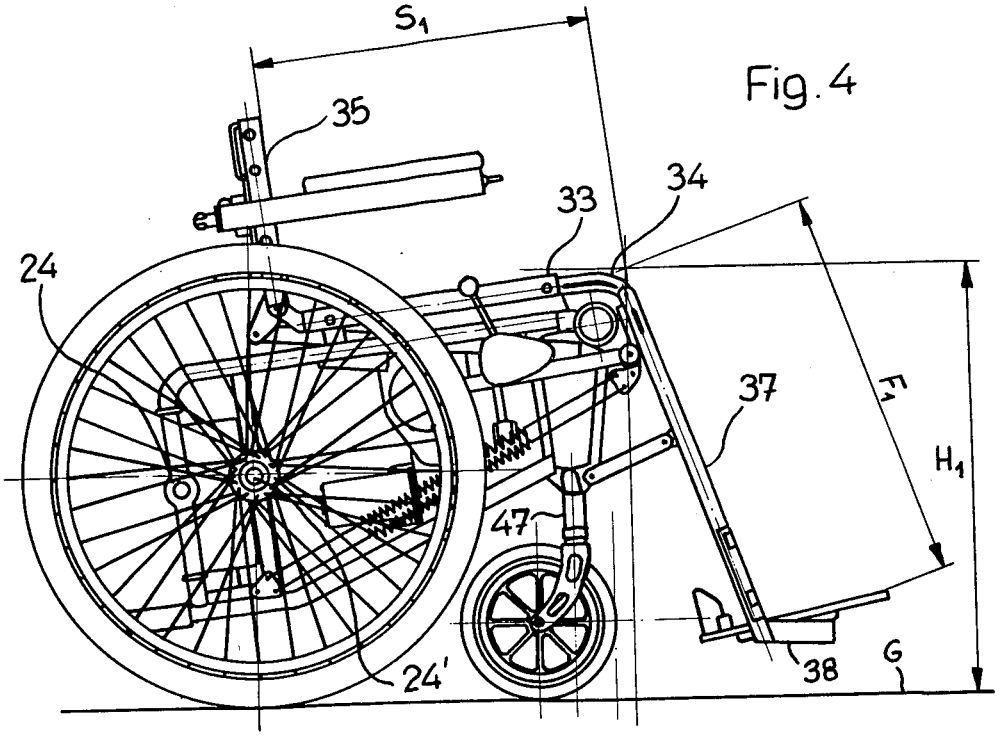
Figure 5:
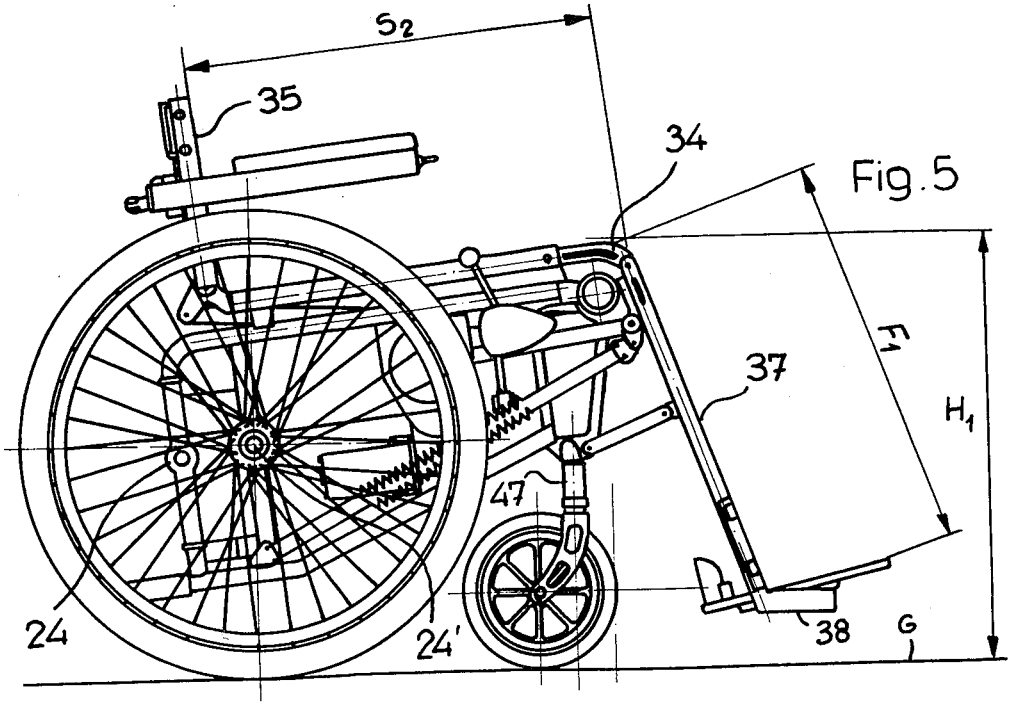
Figure 6:
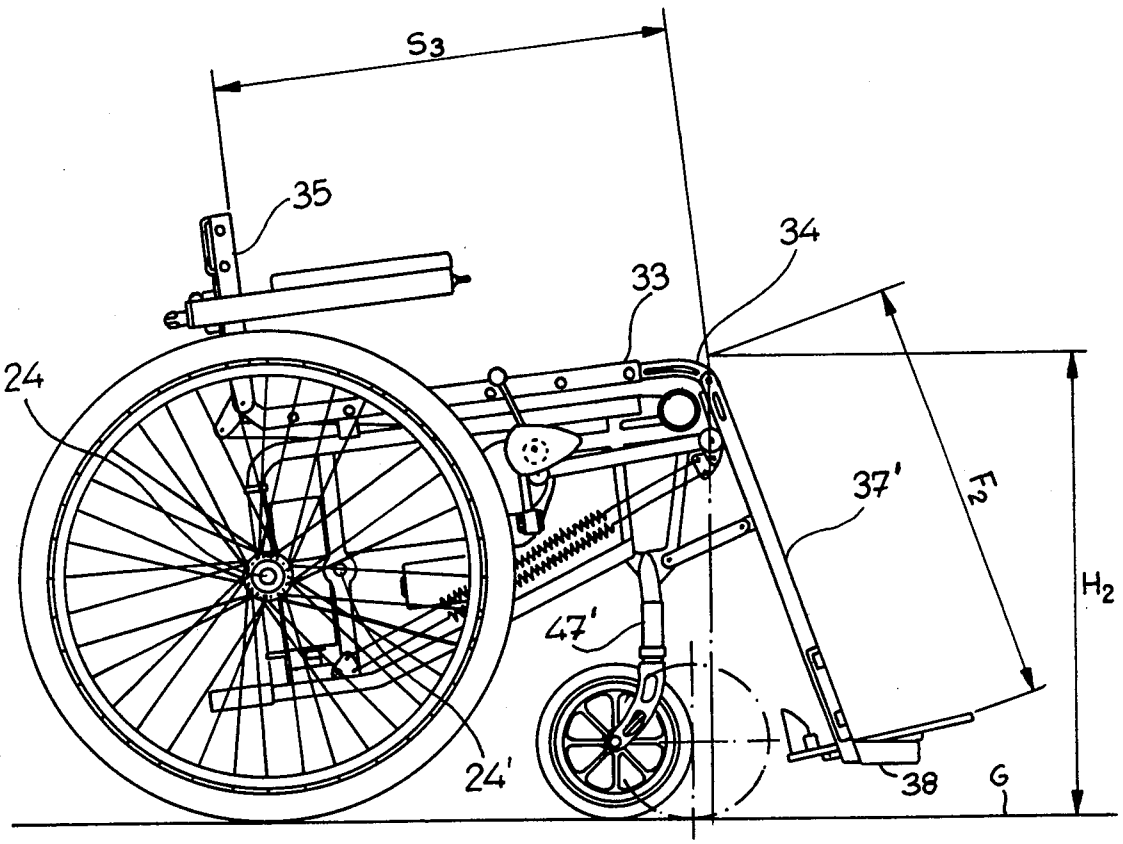

FIG. 1 is a schematic side view of a wheelchair of the prior art, and is essentially similar to FIG. 1 of the referenced U.S. Pat. No. 4,076,304;

FIG. 2 is a perspective side view, similar to FIG. 2 of the referenced patent;

FIG. 3 is a schematic side view similar to FIG. 1, omitting all elements not necessary for an understanding of the invention which permits adapting the prior art chair to different sizes; and FIGS. 4, 5 and 6 are highly schematic side views illustrating adjustments of the chair for different heights, and for different sizes of patients, and dimensional relationships with respect thereto wherein FIG. 4 is a chair arranged for children;

FIG. 5 a chair arranged for persons of average height; and

FIG. 6 a chair adapted for persons of above-average size and height.

The chair illustrated, in part, in FIGS. 1 and 2, is similar to that described in the aforementioned U.S. Pat. No. 4,076,304, and has a main frame 11 to which a seating and erecting frame 13 is connected, pivotable about a pivot axis 15 with respect to the main frame 11. The main frame 11 has two side frame elements 17, 19 made of welded tubular elements which are connected by cross struts, shown in greater detail in FIG. 2 for purposes of clarity. By moving the cross struts in the direction of the arrow 23 (FIG. 2), the distance between the cross struts can be changed, or the cross struts can be moved close to each other for collapsing of the chair.

Two main wheels 25 and two front guide casters 47 are secured to the frame 11. A drive mechanism 31, operated by a switch 29, is secured to the frame 11, in order to provide for erection of a chair by movement about the pivot axis 15. The pivot axis 15, actually, can be formed by pivot bearings in a plate **45*c* forming part of two parallel linkage arms 45*a*, 45*b* (FIG. 1), the other end of the parallel linkage being formed by the back 35** of the chair.

The frame 13 for the seat and the erection includes the seat 33, the back 35, and the footrest 37. Except for the footrest, which includes plate elements, the frame 13 is formed of tubular elements. A collapsible strut 39 provides for stability in the region of the backrest. The seat 33 actually is formed by a loop of fabric or by a leather panel, the outlines of seat and back are illustrated by the heavy lines 41, 43 in FIG. 3. The parallelogram linkage 45, shown only generally in FIG. 3 and in detail in FIG. 1, is provided to position the backrest 35 with respect to the frame 11 in any desired position, that is, in the seated position as shown in FIGS. 1 and 3, or in erected position.

The footrests include struts 37 and footrest panels 40 and floor or ground supports 38. They are so arranged that the ground supports are solid on the ground when the chair is erected. The footrest struts 37 are surrounded by tubular members to which the foot panels 40 are attached to permit height adjustment of the foot panels with respect to the seat 33. For further details of the construction, reference is made to the U.S. Pat. No. 4,076,304, DEUCHER.

In accordance with the invention, the seat 33, the foot support struts 37, and the linkage 45 can be replaced by elements of different sizes, so arranged that the relative positioning of the erecting mechanism and of the ground supports 38 with respect to the pivot axis 15 is maintained.

FIG. 3 illustrates the structure in accordance with the invention which, as can be seen, is basically similar to that of FIGS. 1 and 2, so that the same basic structure can be used. Similar elements have been given the same reference numerals.

In wheelchairs of known construction, the seat, the footrests, and the back, usually are separate, independent elements; in the erecting chair as described in U.S. Pat. No. 4,076,304, DEUCHER, as well as in the chair of the present invention, the seat and the footrest, together with the back seat form the seating and erecting frame unit 13 which has a very specific relationship to the rolling frame 11, in that it is pivotable about the pivot axis 15 with respect to the frame 11. These specific dimensional relationships previously required matching of the specific wheelchair to patients of various sizes. For example, in order to permit exchange of the seat 33 and the footrest struts 37, it is also necessary to exchange the parallelogram linkage 45 by links of different lengths. Additionally, and in accordance with the feature of the invention, the side frame elements 17, 19 of the frame 11 have two bearing support positions 24, 24' for the main wheels 25 so that the relative position of the main wheels 25 with respect to the front edge of the seat, as defined by the front edge **34*a*, can be changed. The front edge 34*a* is preferably maintained at a predetermined distance with respect to the pivot axis 15 in order to retain the relationship of the position of the footrest struts 37 with respect to the front edge of the seat and provide for comfortable seating. The front edge 34*a* of the seat can be adjusted with respect to height. It is a requirement of a stable erecting-type wheelchair that, when the erecting wheelchair is erected, that is, the seat 33 is essentially vertical, the foot supports 37, and particularly the ground supports 38 thereof, engage the ground surface. By interchanging the foot supports 37 by foot supports of different lengths, the frame 13, and hence the seat, can be adjusted with respect to height which, further, requires exchange or replacement of the pins or stubs 47 holding the front caster wheels 27. Thus, by shortening or lengthening the front support struts 37 and simultaneously exchanging either the sizes of the casters 27 or—more inexpensively—the position of the casters with respect to the front struts 17—by changing the holding stubs therefor, or the bearing positions therefor, the height of the seat 33 can be adjusted with respect to ground level. Other arrangements to change the height of the wheels 27 with respect to ground can be used, such as telescopic tube-and-pin connections for the casters 27 or the like. Additional individual adjustment can be effected by placing the ground support elements 38 at adjustable heights on the rods or struts 37, for example by a telescopic arrangement; and by placing the foot panels 40 height-adjustably on the supports 37, for example, as shown, by clamping knobs engaging clamping bushings which surround the height adjustment struts 37**.

FIGS. 4, 5 and 6 show, respectively, adjustment of the chair for patients of different sizes, in which FIG. 4 is for the smallest patient, e.g. a child, and FIG. 6 for the largest, for example a taller-than-average patient. A seat 33 of different seat lengths $S_1$, $S_2$, $S_3$ is provided for patients of various sizes; accordingly, the parallelogram linkage 45 is interchanged by link elements of different lengths. The main wheels 25 are preferably positioned for patients of small and average size in the forward bearing points 24'; for taller-than-average patients, the main wheels are placed in the rear bearing position 24. The length of the caster wheel stubs 42 in FIG. 6 is increased to provide a foot height $F_2$, longer than $F_1$ in FIGS. 4 and 5, by using longer caster support pins or bushings 47'. This, then, places the forward edge 34 of the seat at the greater height $H_2$ above ground level G, rather than the height $H_1$ as shown in FIGS. 4 and 5 and permits use of longer foot support struts 37' (FIG. 6) and maintaining the above-ground distance of ground supports 38.

It is thus possible, by merely, essentially, replacing the elongated links **45*a*, 45*b* of the parallelogram linkage 45 to adjust the chair for use by small-to-average size persons, that is, to permit the chair to "grow", for example with a growing child; upon further growth, it may be necessary to provide a higher seat level, which can be obtained by raising the level of the frame upon interchange of the bearing bushings or holding bushings or pins 47 for the front casters 27; additionally, if required, more than two bearing positions 24, 24' for the main wheels 25 can be provided, for example at different height levels, to accomodate persons of different heights. Yet, the erecting feature of the chair is not disturbed, since the relative positioning of the seat, back, and foot support with respect to the pivot axis is not changed by replacing the parallelogram linkage 45. If desired, the actual seat cover, initially, for a child, can be shorter than that for a growing person; since the seat cover will eventually wear, its replacement after some time may be required in any event. Yet, and as seen by comparing FIGS. 4 and 5, a single seat cover can be used, with repositioning of the back being obtained by change of the link elements of the parallelogram linkage, or foreshortening the link elements, for example by a telescoping adjustment thereof and locking the link elements in position to provide for reliable maintenance of respective position of the back and the seat as well as of the footrest 37** upon erecting movement of the chair.

Various changes and modifications may be made within the scope of the inventive concept.

I claim:

1. A size adjustable erecting wheelchair, particularly a collapsible wheelchair, comprising a main frame (11);

two main wheels (25);

at least one caster wheel (27);

at least one caster wheel support means (47) supporting the caster wheel from the frame;

a seat-erecting frame (13);

means for defining a pivot axis (15) on said main frame;

means (24) for securing the main wheels to the frame, having at least two spaced bearing positions (24, 24') located at different distances from said axis (15) for selective positioning of the main wheels closer to, or farther away from, said axis;

said seat-erecting frame including a seat (33) having a forward edge (**34*a*) located by a predetermined distance from said axis, and a back edge (34*b*), a back rest (35) located close to the top surface of the seat at a predetermined distance from said front edge, foot rest support struts (37) and ground supports (38) secured to the struts, said struts connecting the ground support to the seat such that, in the seating position, the ground supports are spaced from ground level (G) while in the erected position, the ground supports (38) are resting on the ground (G), the seat-erecting frame pivoting with respect to said pivot axis (15**);

and a parallelogram linkage (45; **45*a*, 45*b*, 45*c*) connecting the backrest (35), the seat, and said footrest support struts to the main frame (11) and pivotable about said pivot axis, to keep the backrest upright in each position of the seat of the chair with respect to the main frame (11) and to position the ground supports (38) on ground (G) upon erection of the chair, wherein the parallelogram linkage (45, 45*a*, 45*b*, 45*c*) comprises link means of varying lengths for selective positioning of the backrest (35) closer to, or farther away from, said axis (15**) to permit relative adjustment of the length of the seat;

said at least one caster wheel support means (47) being of variable length to permit adjustment of the height of the front edge (**34*a*) of the seat with respect to ground level (G); and wherein the struts (37) are adjustable in length and matched to the length of the caster wheel support means (47), for placement of the ground support (38) on the ground level (G) when the chair is in the erected position, and to raise the ground supports (38) off the ground level (G) when the chair is in the seating position to provide for clearance of the ground supports from the ground level and free rolling of the chair by said main wheel and said at least one caster wheel, while permitting relative adjustment of the height of the seat with respect to ground level, and while maintaining the pivoting relationship of the parallelogram linkage with respect to said axis (15**).

2. A wheelchair according to claim 1, wherein the main frame (11) comprises two substantially parallel side frames (17, 19);

and foldable spacing strut means (21) connecting said parallel side frames (17, 19) for permitting a spread-apart position of the side frames when the chair is in use to transport a person, or a collapsed position for transporting the chair by folding the side frames towards each other.

3. A wheelchair according to claim 1 further including footrest panels (40);

and height-adjustable mounting means securing the footrest panels to the footrest support struts (37).

4. A wheelchair according to claim 1, wherein said parallelogram linkage (45) has a pivot connection to said frame adjacent said pivot axis (15);

and pivot means connecting the parallelogram linkage to said backrest (35).

5. A wheelchair according to claim 1, wherein the parallelogram linkage comprises parallelogram link bars;

and variation in the lengths of said link bars is provided by substituting link bars of varying lengths in said linkage.

6. The combination of a height-adjustable erecting wheelchair as claimed in claim 1 with a plurality of sets of parallelogram link means of different lengths, individual sets of said link means, of respectively different lengths, being positionable in said chair to form said parallelogram linkage and thereby position the backrest (35) with respect to the front edge (34*a*) of the seat, by respectively different distances, while maintaining the relative orientation of the backrest with respect to the seat, regardless of the orientation of the seat with respect to the main frame (11) upon changing the orientation of the seat from a sitting to an erected position of the chair.

* * * * *